US010885856B2

(12) United States Patent
Tan et al.

(10) Patent No.: US 10,885,856 B2
(45) Date of Patent: Jan. 5, 2021

(54) VOLTAGE DROP COMPENSATION METHOD AND DEVICE THEREOF, DISPLAY DEVICE

(71) Applicant: BOE TECHNOLOGY GROUP CO., LTD., Beijing (CN)

(72) Inventors: Wenjing Tan, Beijing (CN); Hui Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/441,788

(22) Filed: Jun. 14, 2019

(65) Prior Publication Data

US 2020/0051508 A1 Feb. 13, 2020

(30) Foreign Application Priority Data

Aug. 7, 2018 (CN) ..... 2018 1 0891633

(51) Int. Cl.
*G09G 3/3291* (2016.01)
*G09G 3/3225* (2016.01)

(52) U.S. Cl.
CPC ..... *G09G 3/3291* (2013.01); *G09G 3/3225* (2013.01); *G09G 2300/043* (2013.01); *G09G 2320/0233* (2013.01)

(58) Field of Classification Search
None
See application file for complete search history.

(56) References Cited

U.S. PATENT DOCUMENTS 9,892,686 B2 2/2018 Xu et al.
10,170,037 B2 1/2019 Choi
2015/0302817 A1* 10/2015 Sun ..... G09G 3/20 345/89

(Continued)

FOREIGN PATENT DOCUMENTS

CN 104867455 A 8/2015
CN 107068047 A 8/2017

(Continued)

OTHER PUBLICATIONS

Chinese Office Action in Chinese Application No. 201810891633.4, dated Oct. 8, 2019 with English translation.

*Primary Examiner* — Christopher R Lamb
(74) *Attorney, Agent, or Firm* — Collard & Roe, P.C.

(57) ABSTRACT

A voltage drop compensation method and a device thereof, and a display device are disclosed. The voltage drop compensation method includes: obtaining an impedance distribution of the plurality of rows of pixels, and constructing a voltage drop model based on the impedance distribution of the plurality of rows of pixels; obtaining a source-end input current of the display panel; determining an input value of the voltage drop model based on the source-end input current, and determining at least one voltage drop corresponding to the at least one pixel row to be compensated according to the input value; and determining, according to the at least one voltage drop, at least one compensation grayscale which is in one-to-one correspondence with the at least one pixel row to be compensated respectively and performing grayscale compensation on the at least one pixel row to be compensated based on the at least one compensation grayscale.

18 Claims, 6 Drawing Sheets

(56) References Cited

U.S. PATENT DOCUMENTS

| | | | | |
|---|---|---|---|---|
| 2016/0019838 | A1* | 1/2016 | Park | G09G 3/3275<br>345/690 |
| 2016/0189628 | A1* | 6/2016 | Choi | G09G 3/3233<br>345/690 |
| 2017/0032742 | A1* | 2/2017 | Piper | G09G 3/3233 |

FOREIGN PATENT DOCUMENTS

| | | | |
|---|---|---|---|
| CN | 107180613 | A | 9/2017 |
| KR | 10-2016-0083157 | A | 7/2016 |

* cited by examiner

VOLTAGE DROP COMPENSATION METHOD AND DEVICE THEREOF, DISPLAY DEVICE

CROSS-REFERENCE TO RELATED APPLICATION

The present application claims priority of Chinese Patent Application No. 201810891633.4, filed on Aug. 7, 2018, the disclosure of which is incorporated herein by reference in its entirety as part of the present application.

TECHNICAL FIELD

The embodiments of the present disclosure relate to a voltage drop compensation method and a device thereof, and a display device.

BACKGROUND

With development of science and technology, active matrix organic light-emitting diode (AMOLED) display devices are generally acknowledged by the industry as display devices with the most developing potentiality due to their advantages of lightness and thinness, bright color, high contrast and so on.

At present, in order to meet the user's pursuit of better visual effect, both a panel size and a resolution of the AMOLED display devices are constantly increasing. However, for an AMOLED display device with a large panel size and a high resolution, when respective pixel units in a display region of the AMOLED display device are powered by using the same power supply voltage ($V_{DD}$), because wires for transmitting electrical signals to the respective pixel units correspondingly have different resistances, respectively, and this easily results in a fact that the same power supply voltage signal has different degrees of voltage drop (IR drop) after being transmitted through the wires, so that the power supply voltage signals actually obtained by the respective pixel units are different, therefore, the pixel units are likely to show different brightness due to the existence of different IR Drops in a case where the same data signal ($V_{data}$) is used to perform display driving on the pixel units, thus leading to uneven display brightness of the AMOLED display device, and adversely affecting a display effect of the AMOLED display device.

SUMMARY

Embodiments of the present disclosure provide a voltage drop compensation method and a device thereof, and a display device, for compensating for a voltage drop of a display device to improve the display effect of the display device.

At least some embodiments of the present disclosure provide a voltage drop compensation method, adapted for a display panel, the display panel comprises a plurality of rows of pixels, and the plurality of rows of pixels comprises at least one pixel row to be compensated; the voltage drop compensation method comprises: obtaining an impedance distribution of the plurality of rows of pixels, and constructing a voltage drop model based on the impedance distribution of the plurality of rows of pixels; obtaining a source-end input current of the display panel, where the source-end input current refers to a total current before the total current is shunt into the plurality of rows of pixels; determining an input value of the voltage drop model based on the source-end input current, and determining at least one voltage drop corresponding to the at least one pixel row to be compensated according to the input value of the voltage drop model; and determining, according to the at least one voltage drop, at least one compensation grayscale which is in one-to-one correspondence with the at least one pixel row to be compensated respectively and performing grayscale compensation on the at least one pixel row to be compensated based on the at least one compensation grayscale.

For example, in the voltage drop compensation method provided by some embodiments of the present disclosure, the impedance distribution of the plurality of rows of pixels is an impedance distribution of the plurality of rows of pixels in a case where the display panel is at a maximum display brightness, and the source-end input current is a source-end input current of the display panel upon real-time display.

For example, in the voltage drop compensation method provided by some embodiments of the present disclosure, determining the input value of the voltage drop model based on the source-end input current comprises: judging whether or not the source-end input current is greater than a current threshold; and taking the source-end input current as the input value of the voltage drop model in a case where the source-end input current is greater than the current threshold.

For example, in the voltage drop compensation method provided by some embodiments of the present disclosure, the plurality of rows of pixels comprise P pixel rows to be compensated, P is an integer greater than 1, determining at least one voltage drop corresponding to the at least one pixel row to be compensated according to the input value of the voltage drop model comprises: determining P voltage drops corresponding to the P pixel rows to be compensated according to the input value of the voltage drop model. Determining, according to the at least one voltage drop, at least one compensation grayscale which is in one-to-one correspondence with the at least one pixel row to be compensated respectively and performing grayscale compensation on the at least one pixel row to be compensated based on the at least one compensation grayscale comprises: determining P compensation grayscales which are in one-to-one correspondence with the P pixel rows to be compensated based on the P voltage drops respectively and performing the grayscale compensation on the P pixel rows to be compensated based on the P compensation grayscales.

For example, in the voltage drop compensation method provided by some embodiments of the present disclosure, after judging whether or not the source-end input current is larger than the current threshold, the voltage drop compensation method further comprises: taking a maximum current of the display panel at the maximum display brightness as the input value of the voltage drop model in a case where the source-end input current is less than or equal to the current threshold. Determining P compensation grayscales which are in one-to-one correspondence with the P pixel rows to be compensated based on the P voltage drops respectively and performing the grayscale compensation on the P pixel rows to be compensated based on the P compensation grayscales comprises: determining the P compensation grayscales of the P pixel rows to be compensated in the display panel based on the P voltage drops, and determining a grayscale compensation mean value based on the P compensation grayscales; multiplying a percentage of the source-end input current in the maximum current by the grayscale compensation mean value to obtain a grayscale compensation reference value of the display panel upon real-time display; performing the grayscale compensation on an initial pixel row to be compensated, at a first side of the P pixel rows to be compensated close to a drive circuit, of the P pixel rows to be compensated according to the grayscale compensation reference value; increasing progressively a grayscale increment in sequence on the grayscale compensation reference value, so as to obtain (P-1) grayscale compensation values corresponding to (P-1) pixel rows to be compensated of the P pixel rows to be compensated except the initial pixel row to be compensated, along a direction from the first side of the P pixel rows to be compensated close to the drive circuit to a second side of the P pixel rows to be compensated away from the drive circuit, the (P-1) grayscale compensation values corresponding to the (P-1) pixel rows to be compensated sequentially increasing; and performing the grayscale compensation on the (P-1) pixel rows to be compensated according to the (P-1) grayscale compensation values.

For example, in the voltage drop compensation method provided by some embodiments of the present disclosure, a number of the plurality of rows of pixels is the same as a number of the P pixel rows to be compensated.

For example, in the voltage drop compensation method provided by some embodiments of the present disclosure, a plurality of row resistances corresponding to the plurality of rows of pixels in the display panel are all equal, and a (n1)-th voltage drop corresponding to a (n1)-th pixel row in the plurality of rows of pixels satisfies a following formula:

$$\Delta V_{n1} = -\frac{I_0 \times r}{2 \times N} \times n1^2 + \left(1 + \frac{1}{2 \times N}\right) \times I_0 \times r \times n1 + I_0 \times (R - r)$$

wherein $\Delta V_{n1}$ is the (n1)-th voltage drop corresponding to the (n1)-th pixel row, n1 is a positive integer, and is a row number of the (n1)-th pixel row in the display panel, N is a positive integer, and is a total number of the plurality of rows of pixels in the display panel, N is greater than n1, r is a row resistance of the (n1)-th pixel row, $I_0$ is the source-end input current of the display panel, and R is a source-end input resistance of the display panel.

For example, in the voltage drop compensation method provided by some embodiments of the present disclosure, in a case where the plurality of row resistances are equal to the source-end input resistance of the display panel, the (n1)-th voltage drop corresponding to the (n1)-th pixel row in the plurality of rows of pixels satisfies a following formula:

$$\Delta V_{n1} = -\frac{I_0 \times r}{2 \times N} \times n1^2 + \left(1 + \frac{1}{2 \times N}\right) \times I_0 \times r \times n1.$$

For example, in the voltage drop compensation method provided by some embodiments of the present disclosure, determining, according to the at least one voltage drop, at least one compensation grayscale which is in one-to-one correspondence with the at least one pixel row to be compensated respectively comprises: predicting, according to the at least one voltage drop, at least one display current of the at least one pixel row to be compensated respectively after voltage drop occurs, and according to the at least one display current, converting the at least one voltage drop into at least one equivalent grayscale corresponding to the at least one pixel row to be compensated respectively; and according to a difference between a target grayscale of each pixel row to be compensated and an equivalent grayscale corresponding to each pixel row to be compensated among the at least one equivalent grayscale, determining a compensation grayscale corresponding to each pixel row to be compensated respectively.

For example, in the voltage drop compensation method provided by some embodiments of the present disclosure, according to the at least one display current, converting the at least one voltage drop into at least one equivalent grayscale corresponding to the at least one pixel row to be compensated respectively comprises: according to a corresponding relationship between a display current of a corresponding pixel row to be compensated and a display brightness of the corresponding pixel row to be compensated and a corresponding relationship between the display brightness and a grayscale of the corresponding pixel row to be compensated, determining a corresponding relationship between the display current and the grayscale; and according to the corresponding relationship between the display current and the grayscale, converting the at least one voltage drop into the at least one equivalent grayscale, respectively.

For example, in the voltage drop compensation method provided by some embodiments of the present disclosure, the corresponding relationship between the display current and the display brightness satisfies a formula: Lum=EF×I; where, I is the display current of the corresponding pixel row to be compensated, Lum is the display brightness of the corresponding pixel row to be compensated, and EF represents a conversion coefficient; the corresponding relationship between the display brightness and the grayscale satisfies a formula: $Lum = A \times Gray^m$, m=2.2; where, A is a grayscale coefficient of the display panel, and Gray is the grayscale of the corresponding pixel row to be compensated; a (n2)-th display current $I_{n2}$, corresponding to a (n2)-th pixel row to be compensated among the at least one pixel row to be compensated, among the at least one display current satisfies a formula: $I_{n2} = \frac{1}{2} \times K \times (V_{data\ n2} - V_{DDn2})^2$; an equivalent grayscale of the (n2)-th pixel row to be compensated satisfies a formula: $A \times (Gray')^{2.2} = \frac{1}{2} \times K \times (V_{data\ n2} - V_{DDn2})^2$; where $V_{DDn2} = V_{DD} - \Delta V_{n2}$; $V_{DDn2}$ is a working voltage of the (n2)-th pixel row to be compensated, $V_{DD}$ is a source-end input voltage of the display panel, and $\Delta V_{n2}$ is a (n2)-th voltage drop corresponding to the (n2)-th pixel row to be compensated; Gray' is an equivalent grayscale of the (n2)-th pixel row to be compensated, K is a voltage-current conversion coefficient, $V_{data\ n2}$ is a data line voltage for the (n2)-th pixel row to be compensated, and n2 is a positive integer and is less than or equal to a number of the at least one pixel row to be compensated.

For example, in the voltage drop compensation method provided by some embodiments of the present disclosure, a target grayscale $G_0$ of the (n2)-th pixel row to be compensated satisfies a formula: $V_{DD} = a \times G_0\ b$, the equivalent grayscale Gray' of the (n2)-th pixel row to be compensated satisfies a formula: $V_{DDn2} = a \times Gray' + b$; a compensation grayscale $\Delta G_n$ of the (n2)-th pixel row to be compensated satisfies a formula: $\Delta G_n = G_0 - Gray' = \Delta V_{n2}/a$; where a is a linear coefficient of a gamma voltage in the display panel, and b is a constant term of the gamma voltage in the display panel.

Some embodiments of the present disclosure further provides a voltage drop compensation device, configured to perform compensation on a display panel. The display panel comprises a plurality of rows of pixels, and the plurality of rows of pixels comprises at least one pixel row to be compensated. The voltage drop compensation device comprises: a current sensor, configured to detect a source-end input current of the display panel; a voltage drop determining module connected to the current sensor, comprising a voltage drop model constructed based on an impedance distribution of the plurality of rows of pixels, and configured to determine an input value of the voltage drop model based on the source-end input current, and determine at least one voltage drop corresponding to the at least one pixel row to be compensated according to the input value of the voltage drop model; and a grayscale compensation module connected to the voltage drop determining module, configured to determine, according to the at least one voltage drop, at least one compensation grayscale which is in one-to-one correspondence with the at least one pixel row to be compensated respectively, and to perform grayscale compensation on the at least one pixel row to be compensated based on the at least one compensation grayscale.

For example, in the voltage drop compensation device provided by some embodiments of the present disclosure, the voltage drop determining module and the grayscale compensation module are integrated into a panel driving chip of the display panel.

For example, in the voltage drop compensation device provided by some embodiments of the present disclosure, the grayscale compensation module is further respectively connected with the at least one pixel row to be compensated through data lines, so as to perform the grayscale compensation on the at least one pixel row to be compensated based on the at least one compensation grayscale.

For example, in the voltage drop compensation device provided by some embodiments of the present disclosure, the voltage drop determining module is configured to: judge whether or not the source-end input current is greater than a current threshold; and take the source-end input current as the input value of the voltage drop model in a case where the source-end input current is greater than the current threshold.

For example, in the voltage drop compensation device provided by some embodiments of the present disclosure, the plurality of rows of pixels comprise P pixel rows to be compensated, P is an integer greater than 1, the voltage drop determining module is configured to: determine P voltage drops corresponding to the P pixel rows to be compensated according to the input value of the voltage drop model; the grayscale compensation module is configured to: determine P compensation grayscales which are in one-to-one correspondence with the P pixel rows to be compensated based on the P voltage drops respectively, and perform the grayscale compensation on the P pixel rows to be compensated based on the P compensation grayscales.

For example, in the voltage drop compensation device provided by some embodiments of the present disclosure, the impedance distribution of the plurality of rows of pixels is an impedance distribution of the plurality of rows of pixels in a case where the display panel is at a maximum display brightness, and the source-end input current is a source-end input current of the display panel upon real-time display, after judging whether or not the source-end input current is larger than the current threshold, the voltage drop determining module is further configured to: take a maximum current of the display panel at the maximum display brightness as the input value of the voltage drop model in a case where the source-end input current is less than or equal to the current threshold. The grayscale compensation module is further configured to: determine the P compensation grayscales of the P pixel rows to be compensated in the display panel based on the P voltage drops, and determine a grayscale compensation mean value based on the P compensation grayscales; multiply a percentage of the source-end input current in the maximum current by the grayscale compensation mean value to obtain a grayscale compensation reference value of the display panel upon real-time display; perform the grayscale compensation on an initial pixel row to be compensated, at a first side of the P pixel rows to be compensated close to a drive circuit, of the P pixel rows to be compensated according to the grayscale compensation reference value; increase progressively a grayscale increment in sequence on the grayscale compensation reference value, so as to obtain (P-1) grayscale compensation values corresponding to (P-1) pixel rows to be compensated of the P pixel rows to be compensated except the initial pixel row to be compensated, along a direction from the first side of the P pixel rows to be compensated close to the drive circuit to a second side of the P pixel rows to be compensated away from the drive circuit, the (P-1) grayscale compensation values corresponding to the (P-1) pixel rows to be compensated sequentially increasing; and perform the grayscale compensation on the (P-1) pixel rows to be compensated according to the (P-1) grayscale compensation values.

For example, in the voltage drop compensation device provided by some embodiments of the present disclosure, the grayscale compensation module is configured to: predict, according to the at least one voltage drop, at least one display current of the at least one pixel row to be compensated respectively after voltage drop occurs, and according to the at least one display current, convert the at least one voltage drop into at least one equivalent grayscale corresponding to the at least one pixel row to be compensated respectively; and according to a difference between a target grayscale of each pixel row to be compensated and an equivalent grayscale corresponding to each pixel row to be compensated among the at least one equivalent grayscale, determine a compensation grayscale corresponding to each pixel row to be compensated respectively.

Some embodiments of the present disclosure further provides a display device, comprising a display panel and a voltage drop compensation device. The voltage drop compensation device is configured to perform compensation on the display panel, the display panel comprises a plurality of rows of pixels, and the plurality of rows of pixels comprises at least one pixel row to be compensated, the voltage drop compensation device comprises: a current sensor, configured to detect a source-end input current of the display panel; a voltage drop determining module connected to the current sensor, comprising a voltage drop model constructed based on an impedance distribution of the plurality of rows of pixels, and configured to determine an input value of the voltage drop model based on the source-end input current, and determine at least one voltage drop corresponding to the at least one pixel row to be compensated according to the input value of the voltage drop model; and a grayscale compensation module connected to the voltage drop determining module, configured to determine, according to the at least one voltage drop, at least one compensation grayscale which is in one-to-one correspondence with the at least one pixel row to be compensated respectively, and perform grayscale compensation on the at least one pixel row to be compensated based on the at least one compensation grayscale.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In order to further illustrate a voltage drop compensation method and a device thereof and a display device provided by the embodiments of the present disclosure, descriptions will be made in detail below in conjunction with the accompanying drawings of the specification.

With continuous increasing of a size of a display panel and a display resolution in an AMOLED display device, compensation methods commonly used in related technologies include an external optical uniformity compensation for characteristics of thin film transistors and a compensation circuit disposed inside a pixel circuit. However, it is difficult for these compensation methods to effectively compensate a voltage drop (IR drop) in the AMOLED display device caused by gradually increasing of the display panel's size, leading to a problem that the AMOLED display device is prone to display uneven.

The embodiments of the present disclosure provide a voltage drop compensation method and a device thereof, and a display device, for compensating a voltage drop of the display device, so as to improve the display effect of the display device. The voltage drop compensation method and the device thereof and the display device provided by the embodiments of the present disclosure can be applied to large-sized AMOLED display devices.

Figure 1:
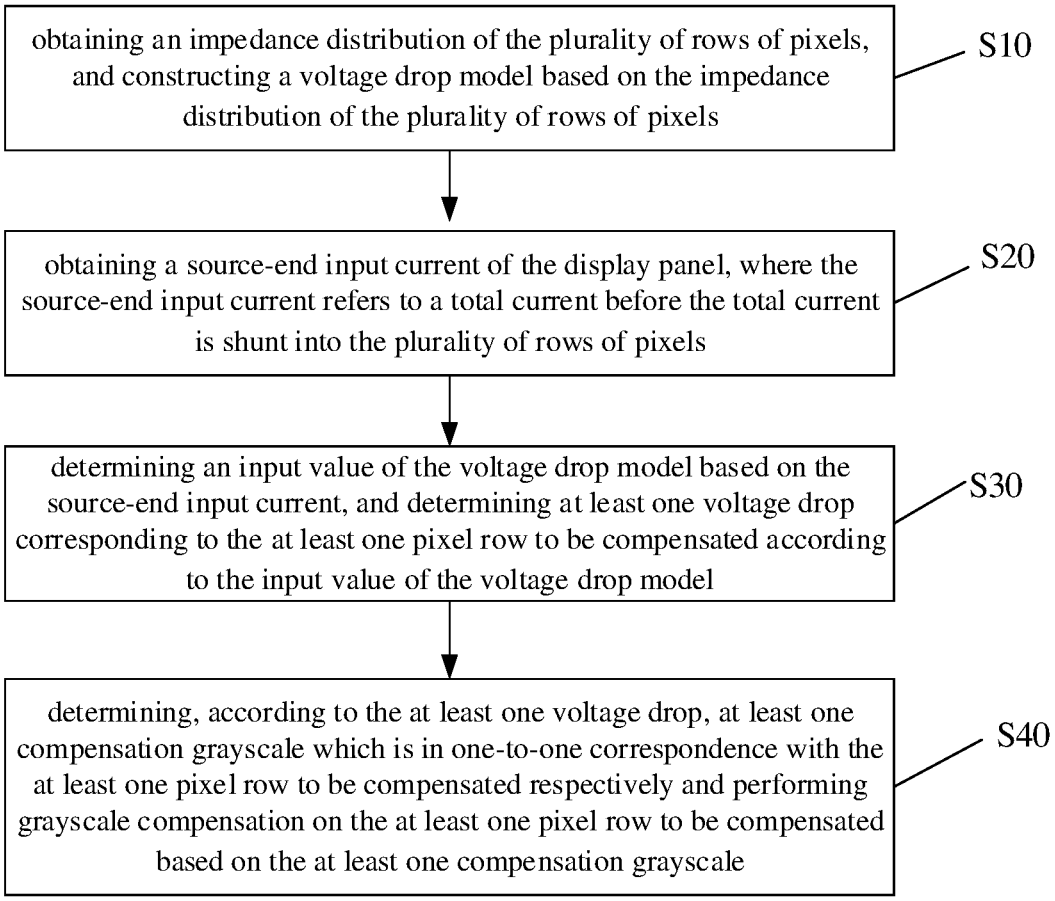
FIG. 1 is a schematic flowchart of a voltage drop compensation method provided by some embodiments of the present disclosure.

FIG. 1 is a schematic flowchart of a voltage drop compensation method provided by some embodiments of the present disclosure. The voltage drop compensation method provided by the embodiment of the present disclosure can be applied to a display panel, and the display panel comprises a plurality of rows of pixels, and the plurality of rows of pixels comprises at least one pixel row to be compensated. Referring to FIG. 1, the voltage drop compensation method includes the following steps:

Step S10, obtaining an impedance distribution of the plurality of rows of pixels, and constructing a voltage drop model based on the impedance distribution of the plurality of rows of pixels.

For example, in step S10, the impedance distribution of the plurality of rows of pixels may be an impedance distribution of the plurality of rows of pixels in the case where the display panel is at the maximum display brightness. When obtaining the impedance distribution of the plurality of rows of pixels in a case where the above display panel is at the maximum display brightness, firstly, the screen gamma and white balance of the display panel are usually debugged to target values, and a display region (AA region) of the display panel is equally divided into a plurality of partitions. Next, a center point of each of the plurality of partitions is obtained, and the grayscale brightness of respective center points of the plurality of partitions at the grayscale of 255 is measured, and working currents of the respective center points and corresponding Gamma voltages are recorded, thereby constructing a function related to the Gamma voltages and the working currents. After that, M sampling points are selected in each row of pixels in the display region of the display panel, and working currents and Gamma voltages of the M sampling points in each row of pixels are collected, so as to obtain a row average current and a row average Gamma voltage of each row of pixels. Finally, quadratic curve fitting is performed on row average currents and row average Gamma voltages of respective rows of pixels and the physical row numbers where the row center points of the respective rows of pixels are located, so as to obtain a quadratic function, the quadratic function is just the voltage drop model that can be constructed according to the impedance distribution of the plurality of rows of pixels. As such, based on a fitting coefficient of the quadratic function and a source-end input current of the display panel at the maximum display brightness, the impedance distribution of the plurality of rows of pixels, that is, a row resistance of each row of pixels, can be obtained by calculation.

Of course, in order to guarantee the accuracy of the above quadratic curve fitting, that is, guarantee the constructing accuracy of the voltage drop model, the above steps may also be repeated to measure other display panels that are produced in the same batch as the display panel and have the same structure in this embodiment, so as to obtain a row resistance of each row of pixels in a plurality of display panels, thus obtaining a row resistance average value of each row of pixels in the display panels, or taking the median of row resistances in a plurality of measuring results as the row resistance of a corresponding row of pixels in the display panel, thereby constructing a more accurate voltage drop model. From the above, by measuring the optical data and electrical signal data of the display panel in the present embodiment, the voltage drop model can be accurately constructed, and therefore, voltage drops of the respective rows of pixels in the display panel are predicted accurately under a condition of different loads, namely, under a condition of different source-end input currents.

For example, each of the plurality of rows of pixels comprises a plurality of pixels.

Step S20, obtaining a source-end input current of the display panel, where the source-end input current refers to a total current before the total current is shunt into the plurality of rows of pixels.

For example, the source-end input current is a source-end input current of the display panel upon real-time display. The source-end input current of the above display panel generally refers to a total current outputted from a power management integrated circuit (PMIC) in the display panel to a display region of the display panel, and the total current has not yet been shunt into each row of pixels.

Step S30, determining an input value of the voltage drop model based on the source-end input current, and determining at least one voltage drop corresponding to the at least one pixel row to be compensated according to the input value of the voltage drop model.

For example, the at least one voltage drop is in one-to-one correspondence with the at least one pixel row to be compensated.

For example, in step S30, in some examples, the source-end input current may be used as the input value of the voltage drop model, to determine a voltage drop corresponding to each row of pixels of the display panel. For example, an output value of the voltage drop model may include the above at least one voltage drop.

Step S40, determining, according to the at least one voltage drop, at least one compensation grayscale which is in one-to-one correspondence with the at least one pixel row to be compensated respectively and performing grayscale compensation on the at least one pixel row to be compensated based on the at least one compensation grayscale.

For example, in step S40, compensation grayscales of corresponding rows of pixels are respectively determined according to the respective voltage drops, and the grayscale compensation is performed on the corresponding rows of pixels respectively according to the compensation grayscales.

The voltage drop compensation method provided by the embodiment of the present disclosure can accurately construct the voltage drop model corresponding to the display panel according to the impedance distribution of the respective rows of pixels of the display panel through obtaining by analysis the impedance distribution of the respective rows of pixels when the display panel is at the maximum display brightness, therefore, after the source-end input current when the display panel is displayed in real-time is obtained, the voltage drop model can be used to predict respective voltage drops of respective rows of pixels when the display panel is displayed in real-time, and determine the compensation grayscales of the corresponding respective rows of pixels according to the respective voltage drops, respectively, so as to perform the grayscale compensation on the corresponding respective rows of pixels based on the compensation grayscales, respectively, and furthermore, voltage drop compensation of the display panel can be achieved by the grayscale compensation, thereby ensuring that the display brightness of the display panel is uniform. Thus, the voltage drop compensation method provided by the embodiment of the present disclosure can perform a customized voltage drop compensation for the display panels of different designs, and has a wide application range and a high compensation accuracy. Moreover, the voltage drop compensation method provided by the embodiment of the present disclosure can implement a long-term uniform display of the display panel after using the grayscale compensation to effectively compensate the voltage drop of the display panel, thereby effectively improving the display effect of the display device where the display panel is located.

Figure 2:
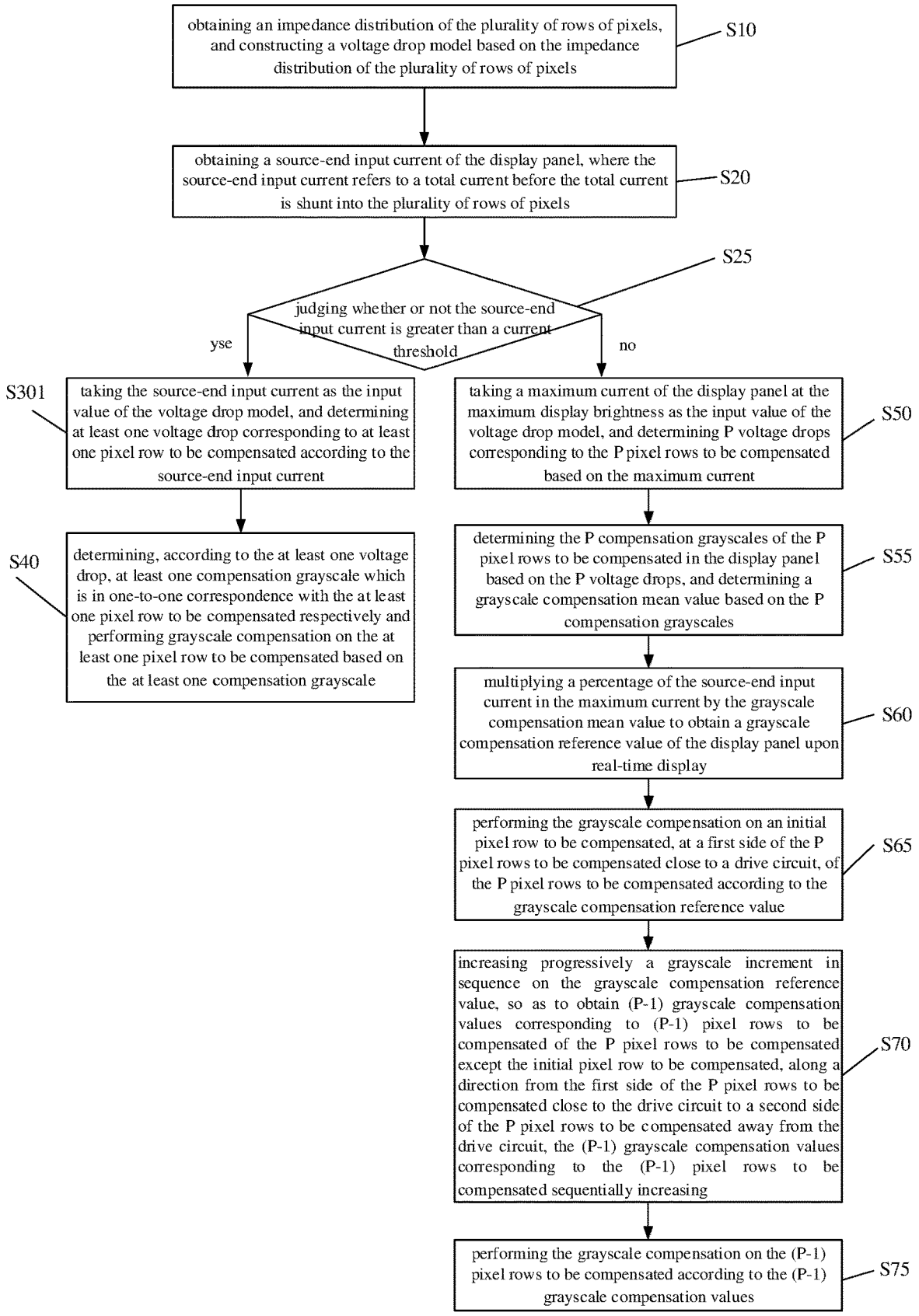
FIG. 2 is a schematic flowchart of another voltage drop compensation method provided by some embodiments of the present disclosure.

It can be understood that, the voltage drop compensation method provided by the above embodiment can be used to accurately compensate for a grayscale display picture under a condition of large current, while for a natural image with a variety of display pictures, other different compensation methods are needed. FIG. 2 is a schematic flowchart of another voltage drop compensation method provided by some embodiments of the present disclosure. Therefore, referring to FIG. 2, when the above step S30 is performed, the voltage drop compensation method provided by the present embodiment further includes:

Step S25, judging whether or not the source-end input current is greater than a current threshold. The current threshold is used to determine a display picture type of the display panel, and may be set by a user according to the actual needs.

As shown in FIG. 2, if the above source-end input current is greater than the current threshold, then the above source-end input current serves as the input value of the voltage drop model, and step S301 and step S40 are performed in sequence. In this case, step S30 may comprise step S301, and as shown in FIG. 2, in step S301, taking the source-end input current as the input value of the voltage drop model, and determining at least one voltage drop corresponding to at least one pixel row to be compensated according to the source-end input current.

For example, in some embodiments, the plurality of rows of pixels include P pixel rows to be compensated, and P is an integer greater than 1, that is, the plurality of rows of pixels include a plurality of pixel rows to be compensated. In this case, step S30 may include: determining P voltage drops corresponding to the P pixel rows to be compensated according to the input value of the voltage drop model. Step S40 may include: determining P compensation grayscales which are in one-to-one correspondence with the P pixel rows to be compensated based on the P voltage drops, and performing the grayscale compensation on the P pixel rows to be compensated based on the P compensation grayscales.

For example, the P voltage drops differ from one another. The P voltage drops are in one-to-one correspondence with the P pixel rows to be compensated, and in some examples, the P pixel rows to be compensated may include a first pixel row to be compensated, a second pixel row to be compensated, a third pixel row to be compensated, . . . , a P-th pixel row to be compensated, then the P voltage drops may include a first voltage drop, a second voltage drop, a third voltage drop, . . . , and a P-th voltage drop. And, the first pixel row to be compensated corresponds to the first voltage drop, the second pixel row to be compensated corresponds to the second voltage drop, the third pixel row to be compensated corresponds to the third voltage drop, and by analogy, and finally, the P-th pixel row to be compensated corresponds to the P-th voltage drop.

For example, the P compensation grayscales are also in one-to-one correspondence with the P pixel rows to be compensated. In some examples, the P compensation grayscales may include a first compensation grayscale, a second compensation grayscale, a third compensation grayscale, . . . , and a P-th compensation grayscale. And, the first pixel row to be compensated corresponds to the first compensation grayscale, the second pixel row to be compensated corresponds to the second compensation grayscale, the third pixel row to be compensated corresponds to the third compensation grayscale, and by analogy, and finally, the P-th pixel row to be compensated corresponds to the P-th compensation grayscale.

It should be noted that, in the embodiments of the present disclosure, "a pixel row to be compensated" represents a pixel row, on which voltage drop compensation needs to be performed, in the display panel, and a pixel row, that does not require to perform the voltage drop compensation, in the display panel may be represented as a normal pixel row. In the display panel, the number of pixel rows to be compensated may be set according to actual needs. In some examples, the plurality of rows of pixels may include one pixel row to be compensated; in other examples, the plurality of rows of pixels may include P pixel rows to be compensated, P is greater than 1 and less than the number of the plurality of rows of pixels; in still other examples, the number of the plurality of rows of pixels is the same as the number of the P pixel rows to be compensated, namely, the plurality of rows of pixels are all pixel rows to be compensated. The present disclosure does not specifically limit the number of pixel rows to be compensated.

As shown in FIG. 2, if the above source-end input current is less than or equal to the current threshold, then step S50, step S60 and step S70 shown in FIG. 2 are performed in sequence. In this case, step S30 shown in FIG. 1 may include step 50 shown in FIG. 2, and step S40 shown in FIG. 1 may include step S55, step S60, step S65, step S70 and step S75 shown in FIG. 2.

For example, as shown in FIG. 2, step S50, taking a maximum current of the display panel at the maximum display brightness as the input value of the voltage drop model, and determining P voltage drops corresponding to the P pixel rows to be compensated based on the maximum current.

Step S55, determining the P compensation grayscales of the P pixel rows to be compensated in the display panel based on the P voltage drops, and determining a grayscale compensation mean value based on the P compensation grayscales.

For example, the grayscale compensation mean value may be a mean value of the P compensation grayscales, and for example, the grayscale compensation mean value may be expressed by the following formula:

$$Gavg = \frac{\sum_{j1=1}^{P} \Delta G_{j1}}{P}$$

Where, Gavg denotes the grayscale compensation mean value, $\Delta G_{j1}$ denotes a (j1)-th compensation grayscale among the P compensation grayscales, j1 is an integer, and $1 \leq j1 \leq P$.

Step S60, multiplying a percentage of the source-end input current in the maximum current by the grayscale compensation mean value to obtain a grayscale compensation reference value of the display panel upon real-time display.

For example, the grayscale compensation reference value may be expressed by the following formula:

$$Gref = \frac{I_0}{I_{max}} \times Gavg$$

where, Gref denotes the grayscale compensation reference value, $I_0$ is the source-end input current of the display panel, and $I_{max}$ is the maximum current of the display panel at the maximum display brightness.

Step S65, performing the grayscale compensation on an initial pixel row to be compensated, at a first side of the P pixel rows to be compensated close to a drive circuit, of the P pixel rows to be compensated according to the grayscale compensation reference value.

For example, the initial pixel row to be compensated represents a pixel row among the P pixel rows to be compensated that is closest to the drive circuit.

Step S70, increasing progressively a grayscale increment in sequence on the grayscale compensation reference value, so as to obtain (P-1) grayscale compensation values corresponding to (P-1) pixel rows to be compensated of the P pixel rows to be compensated except the initial pixel row to be compensated, along a direction from the first side of the P pixel rows to be compensated close to the drive circuit to a second side of the P pixel rows to be compensated away from the drive circuit, the (P-1) grayscale compensation values corresponding to the (P-1) pixel rows to be compensated sequentially increasing.

For example, any one of the (P-1) grayscale compensation values is larger than the grayscale compensation reference value. The (P-1) grayscale compensation values are in one-to-one correspondence with the (P-1) pixel rows to be compensated.

Figure 3:
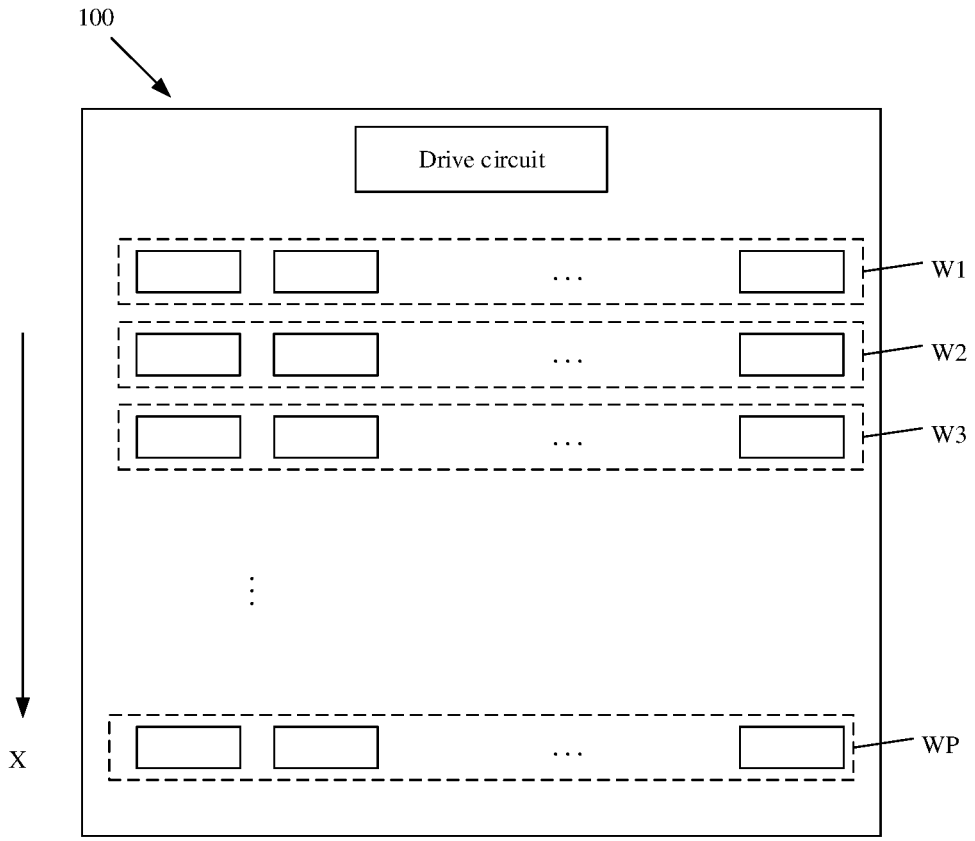
FIG. 3 is a schematic diagram of P pixel rows to be compensated on a display panel provided by some embodiments of the present disclosure.

FIG. 3 is a schematic diagram of P pixel rows to be compensated on a display panel provided by some embodiments of the present disclosure.

For example, as shown in FIG. 3, the direction from the first side of the P pixel rows to be compensated close to the drive circuit to the second side of the P pixel rows to be compensated away from the drive circuit is a first direction X. In the display panel 100 provided by some embodiments of the present disclosure, a first pixel row to be compensated W1, a second pixel row to be compensated W2, a third pixel row to be compensated W3, . . . , a P-th pixel row to be compensated WP are arranged in sequence along the first direction X, the first pixel row to be compensated W1 is closest to the drive circuit, and the P-th pixel row to be compensated WP is farthest from the drive circuit. In the example shown in FIG. 3, the first pixel row to be compensated W1 is the initial pixel row to be compensated, that is, a grayscale compensation value corresponding to the first pixel row to be compensated W1 is the grayscale compensation reference value.

For example, the (P-1) grayscale compensation values corresponding to the (P-1) pixel rows to be compensated increase sequentially along the first direction X. That is to say, the grayscale compensation reference value corresponding to the first pixel row to be compensated W1 is greater than a grayscale compensation value corresponding to the second pixel row to be compensated W2, the grayscale compensation value corresponding to the second pixel row to be compensated W2 is greater than a grayscale compensation value corresponding to the third pixel row to be compensated W3, and the rest is deduced by analogy.

For example, (P-1) grayscale increments corresponding to the (P-1) pixel rows to be compensated are all the same, and in this case, a grayscale compensation value corresponding to a j2-th pixel row to be compensated among the P pixel rows to be compensated may be expressed by the following formula:

$$Gcmpj2=Gref+\Delta Ginc\times(j2-1)$$

Where, Gcmpj denotes the grayscale compensation value corresponding to the (j2)-th pixel row to be compensated, ΔGinc denotes a grayscale increment, and j2 is a positive integer greater than 1 and less than or equal to P.

It should be noted that, FIG. 3 only shows the pixel rows to be compensated in the plurality of rows of pixels, and does not show normal pixel rows (i.e., pixel rows that do not require to perform the voltage drop compensation). The P pixel rows to be compensated may be arranged in sequence, and at least one normal pixel row may be arranged between any two pixel rows to be compensated as well.

Step S75, performing the grayscale compensation on the (P-1) pixel rows to be compensated according to the (P-1) grayscale compensation values.

For example, in step S65, step S70 and step S75, the grayscale compensation is performed on the initial pixel row to be compensated at the first side of the P pixel rows to be compensated, close to the drive circuit (IC), in the display panel based on the grayscale compensation reference value, and in a direction from a first side of the IC to a second side of the IC (that is, in the first direction X shown in FIG. 3), the grayscale increment is increased progressively on the grayscale compensation reference value in sequence so as to obtain a plurality of grayscale compensation values, after that, the grayscale compensation is performed out on corresponding (P-1) pixel rows to be compensated according to the plurality of grayscale compensation values.

For example, a grayscale increment corresponding to each of the above pixel rows to be compensated may be set by s user according to the actual needs. For example, in some examples, (P-1) grayscale increments may also be at least partially different, and the present disclosure does not limit this.

For example, in a case where the plurality of rows of pixels include only one pixel row to be compensated, if the source-end input current is less than or equal to a current threshold, then step S30 may include: taking the maximum current of the display panel at the maximum display brightness as the input value of the voltage drop model, and determining a voltage drop corresponding to the pixel row to be compensated according to the maximum current. The step S40 may include: determining a compensation grayscale of the pixel row to be compensated in a display panel according to the voltage drop, the compensation grayscale just being the grayscale compensation mean value; multiplying a percentage of the source-end input current in the maximum current by the grayscale compensation mean value, so as to obtain a grayscale compensation reference value; and performing the grayscale compensation on the pixel row to be compensated according to the grayscale compensation reference value.

The voltage drop of a row of pixels in the above display panel is generally related to the distance between the row of pixels and the IC in the display panel, namely, a row of pixels in the display panel that is away from the IC will have a greater voltage drop. In the voltage drop compensation method provided by the embodiment of the present disclosure, by comparing the source-end input current when the display panel is displayed in real-time with a threshold value, the voltage drop of each row of pixels in the display panel can be accurately compensated in a case where the source-end input current is relatively large when the display panel is displayed in real-time; and can also perform, and in a case where the source-end input current is relatively small when the display panel is displayed in real-time, by obtaining a grayscale compensation reference value, the grayscale compensation can be performed on an initial pixel row to be compensated close to an IC in the display panel based on the grayscale compensation reference value, and along a direction (that is, the first direction X shown in FIG. 3) from the first side of P pixel rows to be compensated close to the IC to the second side of the P pixel rows to be compensated away from the IC, the grayscale increment is increased progressively on the grayscale compensation reference value in sequence, so as to obtain a plurality of grayscale compensation values, and then the grayscale compensation is performed on the corresponding plurality of pixel rows to be compensated according to the plurality of grayscale compensation values, thereby achieving the rough compensation for the voltage drop of each row of pixels in the display panel.

Figure 4:
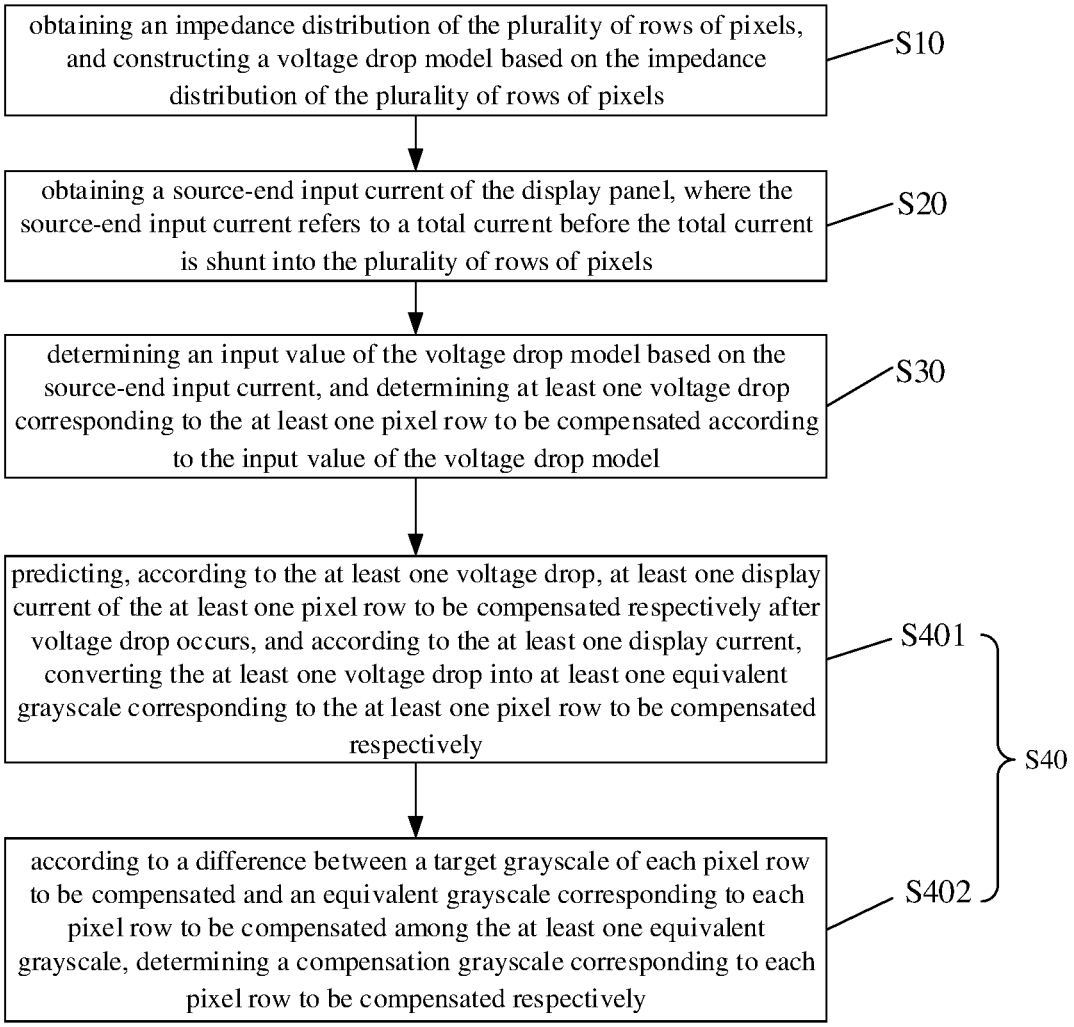
FIG. 4 is a schematic flowchart of still another voltage drop compensation method provided by some embodiments of the present disclosure.
Figure 5:
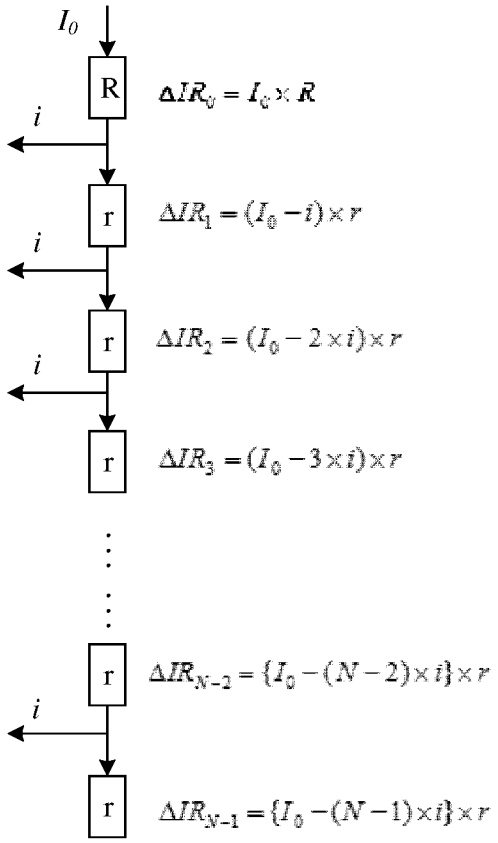
FIG. 5 is a characteristic diagram of an impedance distribution of a display panel provided by some embodiments of the present disclosure.

FIG. 4 is a schematic flowchart of still another voltage drop compensation method provided by some embodiments of the present disclosure; and FIG. 5 is a characteristic diagram of an impedance distribution of a display panel provided by some embodiments of the present disclosure.

For example, referring to FIG. 2 and FIG. 5, resistances on the full screen of the display panel are evenly distributed in general, that is, a plurality of row resistances r corresponding to the plurality of rows of pixels in the display panel are all equal. In a case where the display panel displays a pure grayscale image, respective rows of pixels will be shunted evenly, namely, $I_0=N\times i$, where, $I_0$ is the source-end input current of the display panel, N is a positive integer, and is a total number of the respective rows of pixels in the display panel, and i is the working current of each row of pixels in the display panel.

For example, in some examples, the plurality of rows of pixels may comprise a first pixel row, a second pixel row, a third pixel row, . . . , a (N−2)-th pixel row, and a (N−1)-th pixel row. As shown in FIG. 5, a voltage drop of the first pixel row satisfies the following formula:

$$\Delta IR_1=(I_0-i)\times r.$$

A voltage drop of the second pixel row satisfies the following formula:

$$\Delta IR_2=(I_0-2\times i)\times r.$$

A voltage drop of the third pixel row satisfies the following formula:

$$\Delta IR_3=(I_0-3\times i)\times r.$$

By analogy, a voltage drop of the (n−2)-th pixel row satisfies the following formula:

$$\Delta IR_{N-2}=\{I_0-(N-2)\times i\}\times r.$$

a voltage drop of the (n−1)-th pixel row satisfies the following formula:

$$\Delta IR_{N-1}=\{I_0-(N-1)\times i\}\times r.$$

It should be noted that, the voltage drop of each pixel row represents the product of a row resistance corresponding to each pixel row and a current flowing through each row resistance.

To sum up, a (n1)-th voltage drop corresponding to a (n1)-th pixel row in the plurality of rows of pixels satisfies the following formula:

$$\Delta V_{n1}=\Delta IR_0+\Delta IR_1++\Delta IR_2+\Delta IR_{n1-1}=I_0\times R+(I_0-i)\times r+(I_0-2i)\times r+\ldots+\{I_0-(n1-1)\times i\}\times r \quad (1);$$

Where, $\Delta V_{n1}$ is the (n1)-th voltage drop of the (n1)-th pixel row, n1 is a positive integer, and is the row number of the (n1)-th pixel row in the display panel, r is the row resistance, and R is the source-end input resistance of the display panel. It should be noted that, the (n1)-th voltage drop corresponding to the (n1)-th pixel row represents the sum of voltage drops of (n1-1) pixel rows located before the (n1)-th pixel row along a transmission direction of current. For example, along the transmission direction of current, the first pixel row, the second pixel row, the third pixel row, . . . , an N-th pixel row are arranged sequentially, because the first pixel row and the second pixel row are located before the third pixel row, and then the third voltage drop corresponding to the third pixel row represents the sum of the voltage drop of the first pixel row and the voltage drop of the second pixel row.

It can be obtained according to the above formula (1) that:

$$\Delta V_{n1}=I_0\times R+(n1-1)\times I_0\times r-\frac{n1\times(n1-1)}{2}\times i\times r; \quad (2)$$

$$i=\frac{I_0}{N}$$

is substituted into the formula (2), and it can be obtained that:

$$\Delta V_{n1}=-\frac{I_0\times r}{2\times N}\times n1^2+\left(1+\frac{1}{2\times N}\right)\times I_0\times r\times n1+I_0\times(R-r).$$

As can be seen from this, a voltage drop corresponding to each row of pixels in the display panel is usually a quadratic function related to the position (that is, the row number) where a corresponding row of pixels is located, and coefficients of the quadratic function are generally determined by the source-end input current of the display panel, the source-end input resistance of the display panel, the row resistance of each row of pixels and the total number of the respective rows of pixels.

Assuming that the row resistance r of each row of pixels is equal to the source-end input resistance of the display panel, and the total number N of rows of pixels in the display panel approaches infinity, for example, N is far larger than n1, the above formula for the (n1)-th voltage drop corresponding to the (n1)-th pixel row may be simplified to be:

$$\Delta V_{n1}=-\frac{I_0\times r}{2\times N}\times n1^2+I_0\times r\times n1.$$

That is, the voltage drop corresponding to each row of pixels that can be determined in the above step S30 shall satisfy the following formula:

$$\Delta V_{n1}=-\frac{I_0\times r}{2\times N}\times n1^2+I_0\times r\times n1;$$

where, $\Delta V_{n1}$ is the (n1)-th voltage drop corresponding to the (n1)-th pixel row, n1 is the row number of the (n1)-th pixel row in the display panel, N is a positive integer, and N is the total number of rows of pixels in the display panel, r is the row resistance of the (n1)-th pixel row, and $I_0$ is the source-end input current of the display panel.

It should be noted that, in other embodiments of the present disclosure, the plurality of row resistances corresponding to the plurality of rows of pixels in the display panel may also be at least partially unequal, and the present disclosure is not limited thereto.

It is worth mentioning that, referring to FIG. 4, in the above step S40, the step of determining, according to the at least one voltage drop, at least one compensation grayscale which is in one-to-one correspondence with the at least one pixel row to be compensated respectively includes:

Step S401, predicting, according to the at least one voltage drop, at least one display current of the at least one pixel row to be compensated respectively after voltage drop occurs, and according to the at least one display current, converting the at least one voltage drop into at least one equivalent grayscale corresponding to the at least one pixel row to be compensated respectively.

For example, in step S401, display currents of corresponding pixel rows to be compensated are respectively predicted according to the respective voltage drops after the voltage drop occurs, and according to a corresponding relationship between a display current of a corresponding pixel row to be compensated and the display brightness of the corresponding pixel row to be compensated and a corresponding relationship between the display brightness of the corresponding pixel row to be compensated and a grayscale of the corresponding pixel row to be compensated, a corresponding relationship between the display current of the corresponding pixel row to be compensated and the grayscale of the corresponding pixel row to be compensated is determined. After that, according to the corresponding relationship between the display current of the corresponding pixel row to be compensated and the grayscale of the corresponding pixel row to be compensated, the at least one voltage drop is converted into the at least one equivalent grayscale, respectively, that is, the voltage drop of the corresponding pixel row to be compensated is converted into the equivalent grayscale of the corresponding pixel row to be compensated.

Step S402, according to a difference between a target grayscale of each pixel row to be compensated and an equivalent grayscale corresponding to each pixel row to be compensated among the at least one equivalent grayscale, determining a compensation grayscale corresponding to each pixel row to be compensated respectively. That is, according to the difference between an equivalent grayscale of a corresponding pixel row to be compensated and a target grayscale of the corresponding pixel row to be compensated, a compensated grayscale of the corresponding pixel row to be compensated is determined.

For example, the above corresponding relationship between the display current and the display brightness satisfies the formula: Lum=EF×I; where, I is the display current of the corresponding pixel row to be compensated, Lum is the display brightness of the corresponding pixel row to be compensated, EF represents a conversion coefficient;

and the display brightness Lum of each pixel row to be compensated is direct-proportional to the display current I of the pixel row to be compensated.

In addition, a first display current $I_1$ corresponding to the first pixel row to be compensated among the at least one display current also satisfies the formula:

$$I_1=\tfrac{1}{2}\times K\times(V_{data\ n2}-V_{DDn2})^2.$$

A (n2)-th display current $I_{n2}$ among the at least one display current that corresponds to the (n2)-th pixel row to be compensated among the at least one pixel row to be compensated also satisfies the formula:

$$I_{n2}=\frac{1}{2}\times K\times(V_{data\ n2}-V_{DDn2})^2=\frac{1}{2}\times K\times\{V_{data\ n2}-(V_{DD}-\Delta V_{n2})\}^2=\frac{1}{2}\times K\times(V_{data\ n2}+\Delta V_{n2}-V_{DD})\}^2=\frac{1}{2}\times K\times(V'_{data\ n2}-V_{DD})^2;$$

Where, $V_{DDn2}$ is the working voltage of the (n2)-th pixel row to be compensated, $V_{DD}$ is the source-end input voltage of the display panel, $\Delta V_{n2}$ is the (n2)-th voltage drop corresponding to the (n2)-th pixel row to be compensated, K is a voltage-current conversion coefficient, $K_{data\ n2}$ is a data line voltage for the (n2)-th pixel row to be compensated, $V'_{data\ n2}$ is a compensated data line voltage of the (n2)-th pixel row to be compensated after performing compensation on the (n2)-th pixel row to be compensated, and n2 is a positive integer and is less than or equal to the number of at least one pixel row to be compensated.

For example, the above corresponding relationship between the display brightness and the grayscale satisfies the formula: $Lum=A\times Gray^m$, m=2.2; where, A is a grayscale coefficient of the display panel, and Gray is the grayscale of the corresponding pixel row to be compensated, namely, the grayscale before the corresponding pixel row to be compensated is compensated.

According to $A\times(Gray)^{22}=EF\times I_{n20}=EF=\tfrac{1}{2}\times K\times(V_{data\ n2}-V_{DDn2})^2$, it can be obtained that:

$$\Delta\times(Gray')^{2.2}=EF=I_{n2}=EF=\tfrac{1}{2}\times K\times(V'_{data\ n2}-V_{DD})^2;$$

Thus, $A\times(Gray')^{2.2}=EF\times\tfrac{1}{2}\times K\times(V_{data\ n2}-V_{DDn2})^2$, Where, $I_{n20}$ represents a current determined based on the grayscale Gray before performing compensation on the corresponding pixel row to be compensated.

Thus, equivalent grayscales of the respective rows of pixels in the display panel after occurrence of voltage drop all satisfy the formula:

$$A\times(Gray')^{2.2}=EF=\tfrac{1}{2}\times K\times(V_{data\ n2}-V_{DDn2})^2;\ \text{where,}\quad V_{DDn2}=V_{DD}-\Delta V_{n2};$$

where, VDDn2 is the working voltage of the (n2)-th pixel row to be compensated, $V_{DD}$ is the source-end input voltage, $\Delta V_{n2}$ is the (n2)-th voltage drop corresponding to the (n2)-th pixel row to be compensated; Gray' is the equivalent grayscale of the (n2)-th pixel row to be compensated, K is the voltage-current conversion coefficient, and $V_{data\ n2}$ is a data line voltage for the (n2)-th pixel row to be compensated. Different brightness regions of the display panel can be presented by using different equivalent grayscales.

In addition, the relationship between the working voltage of each row of pixels in the display panel and the display brightness of each row of pixels usually conforms to a screen Gamma voltage curve. For example, a target grayscale $G_0$ of the (n2)-th pixel row to be compensated satisfies the formula: $V_{DD}=a\times G_0+b$, an equivalent grayscale Gray of the (n2)-th pixel row to be compensated satisfies the formula: $V_{DDn2}=a\times Gray'+b$; then a compensated grayscale $\Delta G_n$ corresponding to the (n2)-th pixel row to be compensated shall satisfy the formula: $\Delta G_n=G_0-Gray'=\Delta V_{n2}/a$; where, a is a linear coefficient of Gamma voltage in the display panel, and b is a constant term of gamma voltage in the display panel.

In summary, the voltage drop compensation method provided by the embodiment of the present disclosure can effectively convert voltage drops of respective pixel rows in the display panel into the compensation grayscales of the corresponding pixel rows, so that the display brightness of the corresponding pixel rows in the display panel can be adjusted in real time through the data lines, so as to perform full-screen voltage drop compensation on different images and different positions in the display panel and further effectively improve the display performance of uniform display of the display panel.

Figure 6:
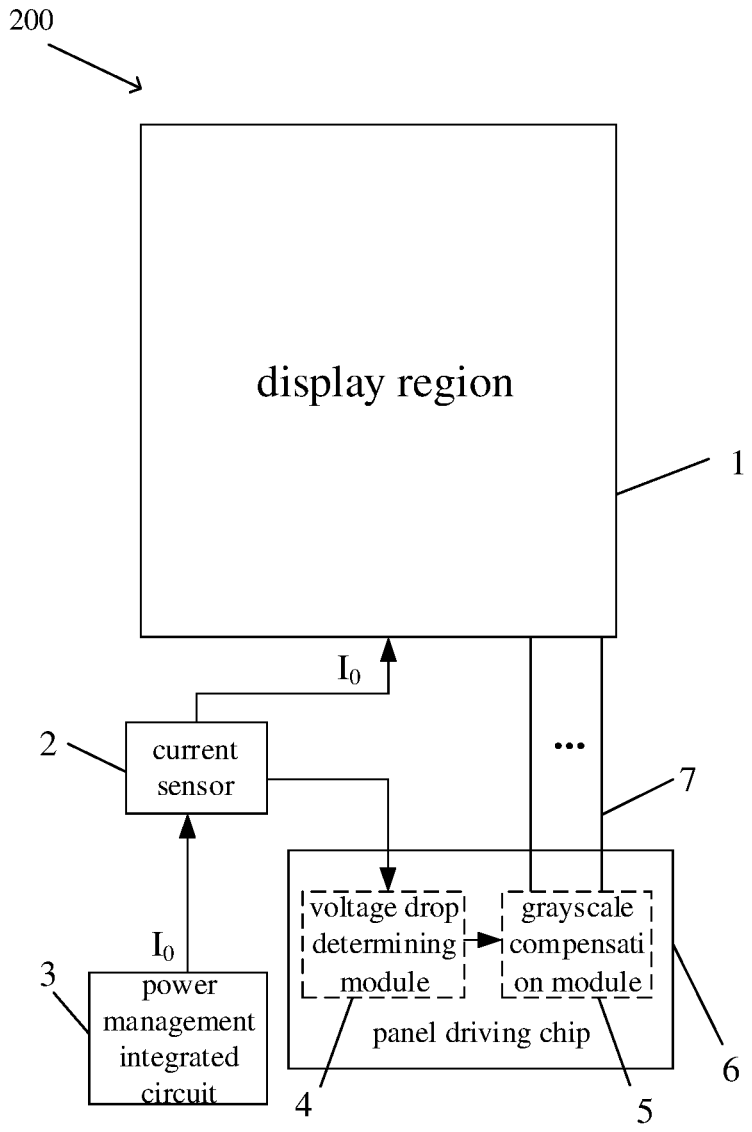
FIG. 6 is a schematic structural diagram of a voltage drop compensation device provided by some embodiments of the present disclosure.

FIG. 6 is a schematic structural diagram of a voltage drop compensation device provided by some embodiments of the present disclosure. Some embodiments of the present disclosure also provide a voltage drop compensation device, configured to compensate a display panel. For example, the voltage drop compensation device may be configured to implement the voltage drop compensation method provided by the above embodiments.

For example, referring to FIG. 6, the voltage drop compensation device includes a current sensor 2, a voltage drop determining module 4 and a grayscale compensation module 5.

For example, the display panel includes a plurality of rows of pixels, and the plurality of rows of pixels include at least one pixel row to be compensated.

For example, the current sensor 2 is configured to detect a source-end input current of the display panel. For example, the source-end input current is a source-end input current of the display panel upon real-time display, and the source-end input current usually refers to a total current outputted from a power management integrated circuit (PMIC) 3 in the display panel to a display region 1 of the display panel, and the total current has not yet been shunt into each row of pixels. The current sensor 2 may be mounted on an electrically connection path between the power management integrated circuit 3 and the display region 1 of the display panel.

For example, the voltage drop determining module 4 is connected to the current sensor 2, and is configured to determine an input value of a voltage drop model based on the source-end input current, and determine at least one voltage drop that corresponds to at least one pixel row to be compensated according to the input value of the voltage drop model. The voltage drop determining module 4 is pre-configured with the voltage drop model that is constructed based on an impedance distribution of the plurality of rows of pixels in the display panel, and the voltage drop model may be configured to predict the voltage drop of each row of pixels when the display panel is displayed in real time after the source-end input current of the display panel upon real-time display has been obtained. For example, in some embodiments, the voltage drop compensation device 200 may further include a modeling module 8, and the modeling module 8 is configured to obtain the impedance distribution of the plurality of rows of pixels, and to construct the voltage drop model based on the impedance distribution of the plurality of rows of pixels, and the voltage drop determining module 4 can obtain the voltage drop model. In other embodiments, the voltage drop determining module 4 may also be configured to obtain the impedance distribution of the plurality of rows of pixels, and to construct the voltage drop model based on the impedance distribution of the plurality of rows of pixels.

For example, the impedance distribution of the plurality of rows of pixels is the impedance distribution of the plurality of rows of pixels in a case where the display panel is at the maximum display brightness.

For example, the grayscale compensation module 5 is connected to the voltage drop determining module 4, and is configured to determine, according to the at least one voltage drop, at least one compensation grayscale which is in one-to-one correspondence with the at least one pixel row to be compensated respectively, and to perform grayscale compensation on the at least one pixel row to be compensated based on the at least one compensation grayscale. For example, the grayscale compensation module 5 is also connected to the at least one pixel row to be compensated, respectively, through data lines 7, so as to perform the grayscale compensation on the at least one pixel row to be compensated based on the at least one compensation grayscale.

For example, the voltage drop determining module 4 may be configured to perform the operations in steps S10 and S30 in the above voltage drop compensation method. The current sensor 2 may be configured to perform the operation in step S20 in the above voltage drop compensation method. The grayscale compensation module 5 may be configured to perform the operation in step S40 in the above voltage drop compensation method.

For example, the voltage drop determining module 4 and the grayscale compensation module 5 may be integrated into a panel driving chip 6 of the display panel. In addition, the voltage drop determining module 4 and the grayscale compensation module 5 may also be an independent function IP (Intellectual Property) in the panel driving chip 6, or be disposed at an AP (Application Processor) terminal of the panel driving chip 6, so as to reduce the driving power consumption of the panel driving chip 6.

For example, in some embodiments, the voltage drop determining module 4 is configured to judge whether the source-end input current is greater than a current threshold or not; and in a case where the source-end input current is greater than the current threshold, take the source-end input current as the input value of the voltage drop model.

For example, in some embodiments, the plurality of rows of pixels include P pixel rows to be compensated, P is an integer greater than 1, and the voltage drop determining module 4 is configured to determine P voltage drops corresponding to the P pixel rows to be compensated according to the input value of the voltage drop model. The grayscale compensation module 5 is configured to determine P compensation grayscales which are in one-to-one correspondence with the P pixel rows to be compensated based on the P voltage drops respectively, and to perform the grayscale compensation on the P pixel rows to be compensated based on the P compensation grayscales.

For example, in some embodiments, after the voltage drop determining module 4 performs the step of judging whether the source-end input current is greater than the current threshold, the voltage drop determining module 4 is also configured to take the maximum current of the display panel at the maximum display brightness as the input value of the voltage drop model in a case where the source-end input current is less than or equal to the current threshold. The grayscale compensation module 5 is also configured to determine the P compensation grayscales of the P pixel rows to be compensated in the display panel based on the P voltage drops, and determine a grayscale compensation mean value based on the P compensation grayscales; multiply the percentage of the source-end input current in the maximum current by the grayscale compensation mean value, thereby obtaining a grayscale compensation reference value of the display panel upon real-time display; perform the grayscale compensation on an initial pixel row to be compensated, at a first side of the P pixel rows to be compensated close to a drive circuit, of the P pixel rows to be compensated according to the grayscale compensation reference value; increase progressively a grayscale increment in sequence on the grayscale compensation reference value, so as to obtain (P-1) grayscale compensation values that correspond to (P-1) pixel rows to be compensated of the P pixel rows to be compensated except the initial pixel row to be compensated, along a direction from the first side of the P pixel rows to be compensated close to the drive circuit to a second side of the P pixel rows to be compensated away from the drive circuit, the (P-1) grayscale compensation values corresponding to the (P-1) pixel rows to be compensated sequentially increasing; and perform the grayscale compensation on the (P-1) pixel rows to be compensated, according to the (P-1) grayscale compensation values.

For example, in some embodiments, when an operation of determining, according to the at least one voltage drop, at least one compensation grayscale which is in one-to-one correspondence with the at least one pixel row to be compensated respectively is performed, the grayscale compensation module 5 is configured to: predict, according to the at least one voltage drop, at least one display current of the at least one pixel row to be compensated respectively after voltage drop occurs, and according to the at least one display current, convert the at least one voltage drop into at least one equivalent grayscale corresponding to the at least one pixel row to be compensated respectively; and according to a difference between a target grayscale of each pixel row to be compensated and an equivalent grayscale corresponding to each pixel row to be compensated among the at least one equivalent grayscale, determine a compensation grayscale corresponding to each pixel row to be compensated respectively.

Beneficial effects that can be achieved by the voltage drop compensation device provided by the embodiment of the present disclosure are the same as the beneficial effect that can be achieved by the voltage drop compensation method provided by the above technical solution, and details are omitted herein.

An embodiment of the present disclosure provides a display device, and the display device comprises a display panel and the voltage drop compensation device provided by the above embodiments. For example, the voltage drop compensation device is configured to compensate the display panel, the display panel comprises a plurality of rows of pixels, and the plurality of rows of pixels comprises at least one pixel row to be compensated. The voltage drop compensation device comprises: a current sensor, configured to detect a source-end input current of the display panel; a voltage drop determining module connected to the current sensor, comprising a voltage drop model constructed based on an impedance distribution of the plurality of rows of pixels, and configured to determine an input value of the voltage drop model based on the source-end input current, and determine at least one voltage drop corresponding to the at least one pixel row to be compensated according to the input value of the voltage drop model; and a grayscale compensation module connected to the voltage drop determining module, configured to determine, according to the at least one voltage drop, at least one compensation grayscale which is in one-to-one correspondence with the at least one pixel row to be compensated respectively, and perform grayscale compensation on the at least one pixel row to be compensated based on the at least one compensation grayscale.

Beneficial effects that can be achieved by the display device are the same as beneficial effects that can be achieved by the voltage drop compensation device in the above embodiments, and details are omitted here.

The display device provided by the above embodiment may be a mobile phone, a tablet computer, a notebook computer, a display, a television, a digital photo frame, a navigator or other product or component with a display function.

What are described above is related to the specific implementations of the present disclosure only and not limitative to the scope of the disclosure, within the disclosed technical scope of the present disclosure, the modification and replacement, which any skilled who is familiar with the technical field may easily conceive, should be covered within the scope of the protection of the present disclosure. Therefore, the protection scope of the present disclosure should be based on the protection scope of the claims.

What is claimed is:

1. A voltage drop compensation method, adapted for a display panel, the display panel comprising a plurality of rows of pixels, and the plurality of rows of pixels comprising at least one pixel row to be compensated, wherein the voltage drop compensation method comprises:

obtaining an impedance distribution of the plurality of rows of pixels, and constructing a voltage drop model based on the impedance distribution of the plurality of rows of pixels;

obtaining a source-end input current of the display panel, where the source-end input current refers to a total current before the total current is shunt into the plurality of rows of pixels;

determining an input value of the voltage drop model based on the source-end input current, and determining at least one voltage drop corresponding to the at least one pixel row to be compensated according to the input value of the voltage drop model; and determining, according to the at least one voltage drop, at least one compensation grayscale which is in one-to-one correspondence with the at least one pixel row to be compensated respectively and performing grayscale compensation on the at least one pixel row to be compensated based on the at least one compensation grayscale;

wherein determining the input value of the voltage drop model based on the source-end input current comprises:

judging whether or not the source-end input current is greater than a current threshold; and taking the source-end input current as the input value of the voltage drop model in a case where the source-end input current is greater than the current threshold.

2. The voltage drop compensation method according to claim 1, wherein the impedance distribution of the plurality of rows of pixels is an impedance distribution of the plurality of rows of pixels in a case where the display panel is at a maximum display brightness, and the source-end input current is a source-end input current of the display panel upon real-time display.

3. The voltage drop compensation method according to claim 1, wherein the plurality of rows of pixels comprise P pixel rows to be compensated, P is an integer greater than 1, determining at least one voltage drop corresponding to the at least one pixel row to be compensated according to the input value of the voltage drop model comprises:

determining P voltage drops corresponding to the P pixel rows to be compensated according to the input value of the voltage drop model; and determining, according to the at least one voltage drop, at least one compensation grayscale which is in one-to-one correspondence with the at least one pixel row to be compensated respectively and performing grayscale compensation on the at least one pixel row to be compensated based on the at least one compensation grayscale comprises:

determining P compensation grayscales which are in one-to-one correspondence with the P pixel rows to be compensated based on the P voltage drops respectively and performing the grayscale compensation on the P pixel rows to be compensated based on the P compensation grayscales.

4. The voltage drop compensation method according to claim 3, wherein after judging whether or not the source-end input current is larger than the current threshold, the voltage drop compensation method further comprises:

taking a maximum current of the display panel at the maximum display brightness as the input value of the voltage drop model in a case where the source-end input current is less than or equal to the current threshold, determining P compensation grayscales which are in one-to-one correspondence with the P pixel rows to be compensated based on the P voltage drops respectively and performing the grayscale compensation on the P pixel rows to be compensated based on the P compensation grayscales comprises:

determining the P compensation grayscales of the P pixel rows to be compensated in the display panel based on the P voltage drops, and determining a grayscale compensation mean value based on the P compensation grayscales;

multiplying a percentage of the source-end input current in the maximum current by the grayscale compensation mean value to obtain a grayscale compensation reference value of the display panel upon real-time display;

performing the grayscale compensation on an initial pixel row to be compensated, at a first side of the P pixel rows to be compensated close to a drive circuit, of the P pixel rows to be compensated according to the grayscale compensation reference value;

increasing progressively a grayscale increment in sequence on the grayscale compensation reference value, so as to obtain (P-1) grayscale compensation values corresponding to (P-1) pixel rows to be compensated of the P pixel rows to be compensated except the initial pixel row to be compensated, along a direction from the first side of the P pixel rows to be compensated close to the drive circuit to a second side of the P pixel rows to be compensated away from the drive circuit, the (P-1) grayscale compensation values corresponding to the (P-1) pixel rows to be compensated sequentially increasing; and performing the grayscale compensation on the (P-1) pixel rows to be compensated according to the (P-1) grayscale compensation values.

5. The voltage drop compensation method according to claim 3, wherein a number of the plurality of rows of pixels is the same as a number of the P pixel rows to be compensated.

6. The voltage drop compensation method according to claim 1, wherein a plurality of row resistances corresponding to the plurality of rows of pixels in the display panel are all equal, and a (n1)-th voltage drop corresponding to a (n1)-th pixel row in the plurality of rows of pixels satisfies a following formula:

$$\Delta V_{n1} = -\frac{I_0 \times r}{2 \times N} \times n1^2 + \left(1 + \frac{1}{2 \times N}\right) \times I_0 \times r \times n1 + I_0 \times (R - r),$$

wherein $\Delta V_{n1}$ is the (n1)-th voltage drop corresponding to the (n1)-th pixel row, n1 is a positive integer, and is a row number of the (n1)-th pixel row in the display panel, N is a positive integer, and is a total number of the plurality of rows of pixels in the display panel, N is greater than n1, r is a row resistance of the (n1)-th pixel row, $I_0$ is the source-end input current of the display panel, and R is a source-end input resistance of the display panel.

7. The voltage drop compensation method according to claim 6, wherein in a case where the plurality of row resistances are equal to the source-end input resistance of the display panel, the (n1)-th voltage drop corresponding to the (n1)-th pixel row in the plurality of rows of pixels satisfies a following formula:

$$\Delta V_{n1} = -\frac{I_0 \times r}{2 \times N} \times n1^2 + \left(1 + \frac{1}{2 \times N}\right) \times I_0 \times r \times n1.$$

8. The voltage drop compensation method according to claim 1, wherein determining, according to the at least one voltage drop, at least one compensation grayscale which is in one-to-one correspondence with the at least one pixel row to be compensated respectively comprises:

predicting, according to the at least one voltage drop, at least one display current of the at least one pixel row to be compensated respectively after voltage drop occurs, and according to the at least one display current, converting the at least one voltage drop into at least one equivalent grayscale corresponding to the at least one pixel row to be compensated respectively; and according to a difference between a target grayscale of each pixel row to be compensated and an equivalent grayscale corresponding to each pixel row to be compensated among the at least one equivalent grayscale, determining a compensation grayscale corresponding to each pixel row to be compensated respectively.

9. The voltage drop compensation method according to claim 8, wherein according to the at least one display current, converting the at least one voltage drop into at least one equivalent grayscale corresponding to the at least one pixel row to be compensated respectively comprises:

according to a corresponding relationship between a display current of a corresponding pixel row to be compensated and a display brightness of the corresponding pixel row to be compensated and a corresponding relationship between the display brightness and a grayscale of the corresponding pixel row to be compensated, determining a corresponding relationship between the display current and the grayscale; and according to the corresponding relationship between the display current and the grayscale, converting the at least one voltage drop into the at least one equivalent grayscale, respectively.

10. The voltage drop compensation method according to claim 9, wherein the corresponding relationship between the display current and the display brightness satisfies a formula: Lum=EF×I; where, I is the display current of the corresponding pixel row to be compensated, Lum is the display brightness of the corresponding pixel row to be compensated, and EF represents a conversion coefficient;

the corresponding relationship between the display brightness and the grayscale satisfies a formula: $Lum=A \times Gray^m$, m=2.2; where, A is a grayscale coefficient of the display panel, and Gray is the grayscale of the corresponding pixel row to be compensated;

a (n2)-th display current $I_{n2}$, corresponding to a (n2)-th pixel row to be compensated among the at least one pixel row to be compensated, among the at least one display current satisfies a formula:

$$I_{n2} = \frac{1}{2} \times K \times (V_{datan2} - V_{DDn2})^2;$$

an equivalent grayscale of the (n2)-th pixel row to be compensated satisfies a formula:

$$A \times (Gray')^{2.2} = EF \times \frac{1}{2} \times K \times (V_{datan2} - V_{DDn2})^2;$$

where $V_{DDn2}=V_{DD}-\Delta V_{n2}$, $V_{DDn2}$ is a working voltage of the (n2)-th pixel row to be compensated, $V_{DD}$ is a source-end input voltage of the display panel, and $\Delta V_{n2}$ is a (n2)-th voltage drop corresponding to the (n2)-th pixel row to be compensated; Gray' is an equivalent grayscale of the (n2)-th pixel row to be compensated, K is a voltage-current conversion coefficient, $V_{data\ n2}$ is a data line voltage for the (n2)-th pixel row to be compensated, and n2 is a positive integer and is less than or equal to a number of the at least one pixel row to be compensated.

11. The voltage drop compensation method according to claim 10, wherein a target grayscale $G_0$ of the (n2)-th pixel row to be compensated satisfies a formula: $V_{DD}=a \times G_0+b$, the equivalent grayscale Gray' of the (n2)-th pixel row to be compensated satisfies a formula: $V_{DDn2}=a \times Gray'+b$;

a compensation grayscale $\Delta G_n$ of the (n2)-th pixel row to be compensated satisfies a formula: $\Delta G_n=G_0-Gray'=\Delta V_{n2}/a$; where a is a linear coefficient of a gamma voltage in the display panel, and b is a constant term of the gamma voltage in the display panel.

12. A voltage drop compensation device, configured to perform compensation on a display panel, the display panel comprising a plurality of rows of pixels, and the plurality of rows of pixels comprising at least one pixel row to be compensated, wherein the voltage drop compensation device comprises:

a current sensor, configured to detect a source-end input current of the display panel;

a voltage drop determining module connected to the current sensor, comprising a voltage drop model constructed based on an impedance distribution of the plurality of rows of pixels, and configured to determine an input value of the voltage drop model based on the source-end input current, and determine at least one voltage drop corresponding to the at least one pixel row to be compensated according to the input value of the voltage drop model; and a grayscale compensation module connected to the voltage drop determining module, configured to determine, according to the at least one voltage drop, at least one compensation grayscale which is in one-to-one correspondence with the at least one pixel row to be compensated respectively, and to perform grayscale compensation on the at least one pixel row to be compensated based on the at least one compensation grayscale;

wherein the voltage drop determining module is configured to:

judge whether or not the source-end input current is greater than a current threshold; and take the source-end input current as the input value of the voltage drop model in a case where the source-end input current is greater than the current threshold.

13. The voltage drop compensation device according to claim 12, wherein the voltage drop determining module and the grayscale compensation module are integrated into a panel driving chip of the display panel.

14. The voltage drop compensation device according to claim 12, wherein the grayscale compensation module is further respectively connected with the at least one pixel row to be compensated through data lines, so as to perform the grayscale compensation on the at least one pixel row to be compensated based on the at least one compensation grayscale.

15. The voltage drop compensation device according to claim 12, wherein the plurality of rows of pixels comprise P pixel rows to be compensated, P is an integer greater than 1, the voltage drop determining module is configured to: determine P voltage drops corresponding to the P pixel rows to be compensated according to the input value of the voltage drop model;

the grayscale compensation module is configured to: determine P compensation grayscales which are in one-to-one correspondence with the P pixel rows to be compensated based on the P voltage drops respectively, and perform the grayscale compensation on the P pixel rows to be compensated based on the P compensation grayscales.

16. The voltage drop compensation device according to claim 15, wherein the impedance distribution of the plurality of rows of pixels is an impedance distribution of the plurality of rows of pixels in a case where the display panel is at a maximum display brightness, and the source-end input current is a source-end input current of the display panel upon real-time display, after judging whether or not the source-end input current is larger than the current threshold, the voltage drop determining module is further configured to: take a maximum current of the display panel at the maximum display brightness as the input value of the voltage drop model in a case where the source-end input current is less than or equal to the current threshold;

the grayscale compensation module is further configured to: determine the P compensation grayscales of the P pixel rows to be compensated in the display panel based on the P voltage drops, and determine a grayscale compensation mean value based on the P compensation grayscales;

multiply a percentage of the source-end input current in the maximum current by the grayscale compensation mean value to obtain a grayscale compensation reference value of the display panel upon real-time display;

perform the grayscale compensation on an initial pixel row to be compensated, at a first side of the P pixel rows to be compensated close to a drive circuit, of the P pixel rows to be compensated according to the grayscale compensation reference value;

increase progressively a grayscale increment in sequence on the grayscale compensation reference value, so as to obtain (P-1) grayscale compensation values corresponding to (P-1) pixel rows to be compensated of the P pixel rows to be compensated except the initial pixel row to be compensated, along a direction from the first side of the P pixel rows to be compensated close to the drive circuit to a second side of the P pixel rows to be compensated away from the drive circuit, the (P-1) grayscale compensation values corresponding to the (P-1) pixel rows to be compensated sequentially increasing; and perform the grayscale compensation on the (P-1) pixel rows to be compensated according to the (P-1) grayscale compensation values.

17. The voltage drop compensation device according to claim 12, wherein the grayscale compensation module is configured to:

predict, according to the at least one voltage drop, at least one display current of the at least one pixel row to be compensated respectively after voltage drop occurs, and according to the at least one display current, convert the at least one voltage drop into at least one equivalent grayscale corresponding to the at least one pixel row to be compensated respectively; and according to a difference between a target grayscale of each pixel row to be compensated and an equivalent grayscale corresponding to each pixel row to be compensated among the at least one equivalent grayscale, determine a compensation grayscale corresponding to each pixel row to be compensated respectively.

18. A display device, comprising a display panel and a voltage drop compensation device, wherein the voltage drop compensation device is configured to perform compensation on the display panel, the display panel comprises a plurality of rows of pixels, and the plurality of rows of pixels comprises at least one pixel row to be compensated, the voltage drop compensation device comprises:

a current sensor, configured to detect a source-end input current of the display panel;

a voltage drop determining module connected to the current sensor, comprising a voltage drop model constructed based on an impedance distribution of the plurality of rows of pixels, and configured to determine an input value of the voltage drop model based on the source-end input current, and determine at least one voltage drop corresponding to the at least one pixel row to be compensated according to the input value of the voltage drop model; and a grayscale compensation module connected to the voltage drop determining module, configured to determine, according to the at least one voltage drop, at least one compensation grayscale which is in one-to-one correspondence with the at least one pixel row to be compensated respectively, and perform grayscale compensation on the at least one pixel row to be compensated based on the at least one compensation grayscale;

wherein the voltage drop determining module is configured to:

judge whether or not the source-end input current is greater than a current threshold; and take the source-end input current as the input value of the voltage drop model in a case where the source-end input current is greater than the current threshold.

* * * * *